US005588264A

United States Patent [19]

Buzon

[11] Patent Number: 5,588,264

[45] Date of Patent: Dec. 31, 1996

[54] METHOD AND APPARATUS FOR SUPPORTING A BUILDING SURFACE

[76] Inventor: Claude Buzon, 2 Place Licourt, 4040 Herstal, Belgium

[21] Appl. No.: 390,851

[22] Filed: Feb. 17, 1995

[51] Int. Cl.[6] ..... B66F 3/10; E04F 15/024

[52] U.S. Cl. ..... 52/126.6; 52/302.1; 52/506.06; 108/150; 248/188.4; 248/354.3; 254/102

[58] Field of Search ..... 52/126.5, 126.6, 52/263, 508, 506.06, 302.1; 411/8, 378, 427, 418, 14; 108/150; 254/13, 102; 248/188.4, 188.5, 354.3, 357

[56] References Cited

U.S. PATENT DOCUMENTS

| | | | |
|---|---|---|---|
| 3,065,506 | 11/1962 | Tremer | 52/126.6 |
| 3,398,933 | 8/1968 | Haroldson | 52/126.6 X |
| 3,645,054 | 2/1972 | Oluera | 52/126.6 |
| 3,812,631 | 5/1974 | Cruse | 52/1 |
| 4,106,256 | 8/1978 | Cody | 52/646 |
| 4,113,219 | 9/1978 | Mieyal | 248/354 R |
| 4,546,580 | 10/1985 | Ueno et al. | 52/126.5 X |
| 4,570,397 | 2/1986 | Creske | 52/126.6 |
| 4,685,258 | 8/1987 | Av-Zuk | 52/126.6 |
| 4,735,024 | 4/1988 | Rosato et al. | 52/126.6 |
| 4,749,302 | 6/1988 | DeClute | 404/37 |
| 5,150,557 | 9/1992 | Gregory | 52/646 |
| 5,333,423 | 8/1994 | Propst | 52/126.6 |
| 5,479,745 | 1/1996 | Kawai et al. | 52/126.6 |

FOREIGN PATENT DOCUMENTS

| | | | |
|---|---|---|---|
| 8900586 | 3/1989 | Netherlands | 52/126.5 |

OTHER PUBLICATIONS

Sales Literature for Terra System One by Wausau Tile.
Sales Literature for Pave–El by Envirospec, Inc.
Sales Literature for roof pavers by Hanover Architectural Products.

*Primary Examiner*—Michael Safavi
*Attorney, Agent, or Firm*—Sheridan Ross P.C.

[57] ABSTRACT

The present invention is a device for supporting, leveling and attaching (where appropriate), an elevated building surface. The device can be raised or lowered by rotating a base member of the device. The device includes a flange member for the support of heavy loads. The device further includes a fluid pathway to remove fluids, such as water, and heat from the support device. The device can be used in outdoor or indoor environments and is capable of supporting the heavy loads applied by many types of building surfaces, such as heavy structural slabs.

6 Claims, 7 Drawing Sheets

METHOD AND APPARATUS FOR SUPPORTING A BUILDING SURFACE

FIELD OF THE INVENTION

This invention relates generally to the support, leveling, and attachment of traffic-bearing surfaces and specifically to the support, leveling, and attachment of raised structural decks and pedestrian traffic surfaces.

BACKGROUND OF THE INVENTION

A widely used method for supporting building surfaces, such as decks, terraces, plazas, promenades and the like, is to use panels, planks, grating, slabs, or pavers supported by pedestals. Structural deck elements are available in a variety of compositions (such as wood, concrete, stone, plastics, metal, and rubber), colors, and textures. In outdoor applications, the deck elements are typically located above a waterproof membrane as a walking surface. The deck elements are typically elevated above the membrane by pedestals to promote drainage, provide a level structural walk surface, and prevent deterioration of or damage to the deck and water-proofing membrane below.

One type of pedestal used to support the deck elements consists of a number of concentric, interconnected hollow cylinders. During use, the cylinders are first moved relative to one another to yield a desired pedestal height and/or orientation and then filled with concrete. The concrete must set up for the pedestal to be stable. This support method is labor intensive and time consuming and thus costly and does not provide for any method of deck attachment.

Another type of pedestal consists of stacking a number of interlocking plates or layers of different stacking materials of different thicknesses. An appropriate number of plates are stacked to yield the desired height. Interlocking plates are used in some systems and generally consist of layers of molded plastic in various thicknesses. These layers do not easily allow for a full range of height adjustment to produce a level deck surface. Moreover, the stability of such plates decreases as the number of plates increases. These pedestals do not provide for any method of deck attachment.

There is a need for low cost support and method for supporting, leveling, and attaching a deck surface.

There is a further need for a pedestal that is stable, especially when extended to heights up to two feet. There is a related need for a pedestal that, when extended, stable and becomes a structural building element.

There is a further related need for a pedestal that is easily adjustable to a broad range of heights.

SUMMARY OF THE INVENTION

The present invention addresses these needs by providing a low cost support device for supporting a deck element of a building surface that can be elevated to a desired height by rotating a component of the device. "Building surface" refers to any type of platform used in a building structure including, for example, a deck, floor, terrace, plaza, arena, podium, roof promenade, penthouse, swimming pool surround, balcony, patio and the like. Compared to existing pedestals, the ability of the device to be rotated to a desired elevation greatly reduces the labor required to elevate the building surface and provides a broader range of elevations to which the device can be adjusted. The support device further addresses the above-noted needs by being stable when extended, able to carry heavy loads (e.g., up to one ton per pedestal), and provide for attachment of the building surface.

In one aspect of the present invention, the support device comprises a base member including (i) a base portion to engage a fixed surface, a body portion, and at least one flange member supporting the body portion relative to the base portion and (ii) a support member having a support surface to attach or engage the building surface. The support member is rotatably engaged with the body portion such that rotation of the base member relative to the support member elevates the support surface.

In a preferred embodiment, the rotation of the support device results from the use of a threaded surface. More specifically, the body portion includes a threaded cylindrical bore engaging a threaded cylindrical projection on the support member.

The substantial load bearing capacity of the support device is made possible by the flange members and other features of the device. For example, the threaded cylindrical projection has a diameter of at least about 2 inches, and the threaded cylindrical bore and projection have no more than about 5 threads/inch.

To further facilitate the ability of the support device to support heavy loads, the support device can include an indicator slot to indicate the maximum extension of the support surface above the base member. The indicator slots are located at the base of the threaded cylindrical projection and have a height equal to a specified number of threads to indicate to the user when the support device is at or beyond its maximum designed extension.

The support device can include one or more coupler members to increase the maximum extension of the device. A coupler member includes a second threaded cylindrical bore to engage the threaded cylindrical projection and a second threaded cylindrical projection to engage the threaded cylindrical projection.

In another aspect of the present invention, the present invention provides a support device that is resistant to water and chemicals in the terrestrial environment. The support device comprises (i) a support member having a support surface to engage a platform, a first threaded surface, and a first fluid pathway to remove fluids from the support surface and (ii) a base member having a second threaded surface engaging the first threaded surface and a second fluid pathway to remove fluids from the base member. The support surface is elevated by rotating the base member relative to the support member. The first and second fluid pathways enable the support device to discharge fluids that can through alternating freeze and thaw cycles cause deterioration in the support device.

In a preferred embodiment, the first threaded surface includes a threaded cylindrical projection extending from the support surface and the first fluid pathway includes at least one inlet on the support face and at least one outlet on the threaded cylindrical projection communicating with the outlet to remove fluids from the support surface. The support surface is substantially planar to inhibit the collection of fluids on the surface. Additionally, the second threaded surface includes a threaded cylindrical bore with the second fluid pathway removing fluids from the bore.

To provide for resistance to fluids, the support device is composed of a synthetic plastic, such as polypropylene, nylon, polystyrene, polycarbonate, (with or without fiber reinforcing), and composites thereof. These materials can be molded to provide for spacers, securement pins and alignment tabs. These materials can also be easily drilled to allow for the use of mechanical fasteners such as screws, bolts, toggles, and other known attachment devices.

In yet another aspect of the present invention, a method is provided for elevating a building surface above a fixed surface. The method includes the steps of: (i) positioning in a selected location a support member rotatably engaging a base member; (ii) rotating the base member to elevate the support member to a desired height; and (iii) engaging the support member with the building surface. This method is a simple technique to elevate a building surface and, as such, requires considerably less time to perform the steps than the time required by existing methods.

If the building surface includes a plurality of adjacent panels, the method can include the additional step of rotating the base member to elevate the support member to the same height as an adjacent support member. In that event, the engaging step follows the rotating step.

To install the adjacent panels, a first panel is installed by the above-noted steps followed by the installation of another panel. In other words, the method includes the additional steps of: (i) second positioning a second support device adjacent to the support device; (ii) second rotating the second base member to elevate the second support member such that the second support member is at substantially the same level as the support member; and (iii) second engaging the second support member with a second panel adjacent to the first panel.

If the panels are arranged in a grid pattern, the method can include the step of aligning a plurality of couplers on the support member with the grid pattern before the rotating step.

If the support device is extended to reveal an indicator slot, the method can include the step of connecting a coupler member to at least one of the support and base members.

Once the deck elements are positioned, the invention allows for mechanical attachment of the deck elements to the supporting pedestals where deemed appropriate.

DETAILED DESCRIPTION

The present invention is directed to an adjustable support device for supporting an elevated building surface exposed to the elements and other fluids. The support device can be set to a desired elevation simply by rotating a component of the device to support a building surface of a desired elevation and orientation. The elevated building surface is typically a relatively flat, level surface composed of a number of panels, such as slabs. Slabs are generally composed of stone, concrete, wood or metal.

Figure 2:
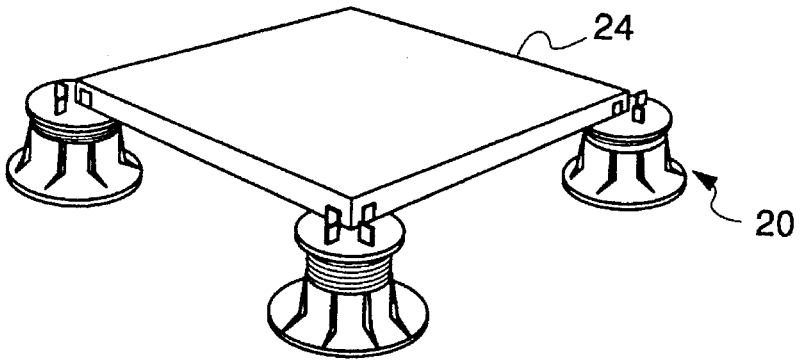
FIG. 2 is another view of the support device supporting a single slab.
Figure 1:
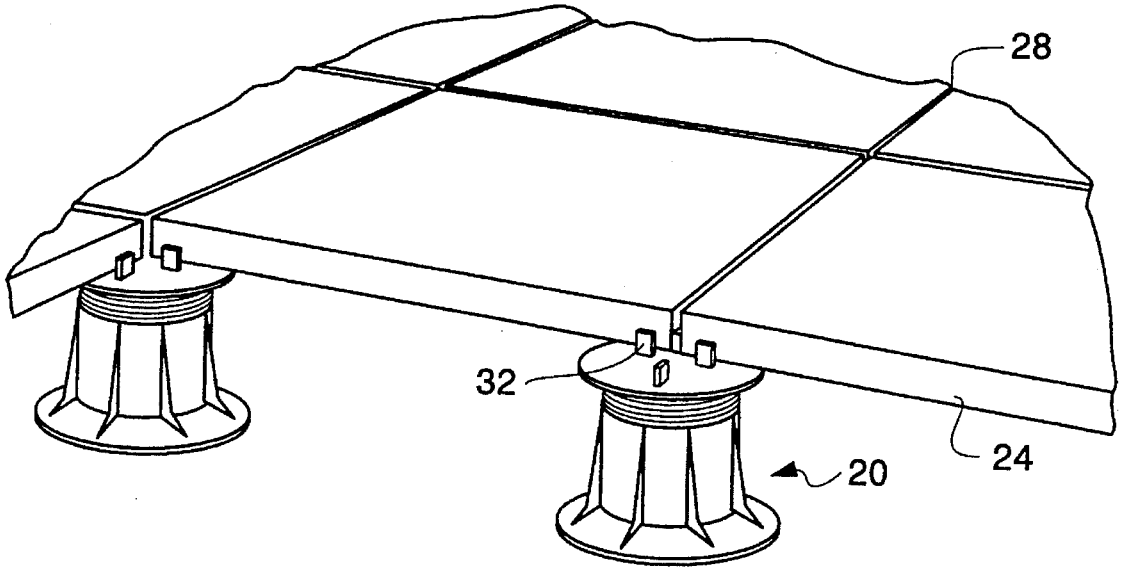
FIG. 1 is a view of a support device according to the present invention supporting a plurality of slabs.

FIGS. 1 and 2 illustrate the use of a support device 20 to elevate a building surface consisting of a number of slabs 24. As can be seen from FIG. 1, the support device 20 supports a number of adjacent slabs 24 with the width of the gap 28 between adjacent slabs 24 being determined by a spacer 32 for spacing the adjacent slabs.

Figure 3:
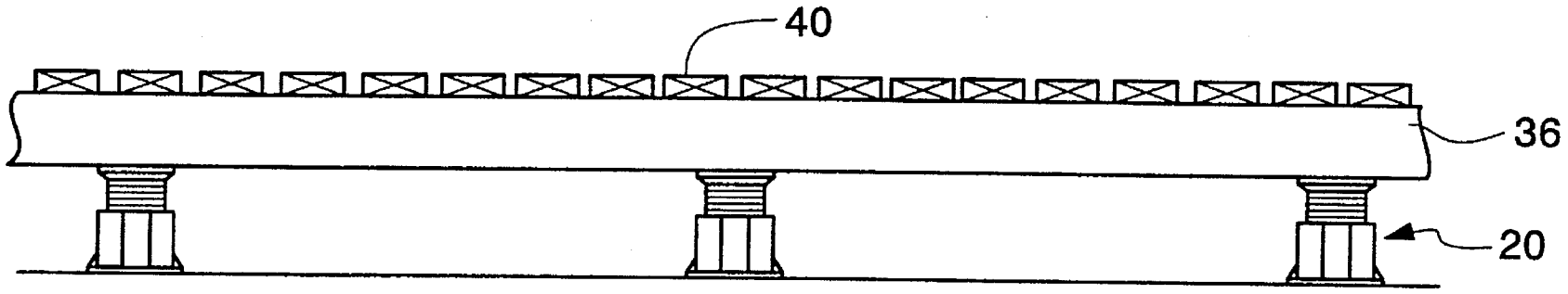
FIG. 3 is another view of the support device supporting a structural member of deck.

FIG. 3 illustrates the use of the support device 20 to support a structural member 36 of a building surface, such as a wooden deck. The spacers 32 have been removed from the support devices 20 to provide a relatively planar surface at the top of the support devices 20 to engage the structural member 36. The structural member 36 supports a number of cross members 40 that form the deck flooring.

Figure 4:
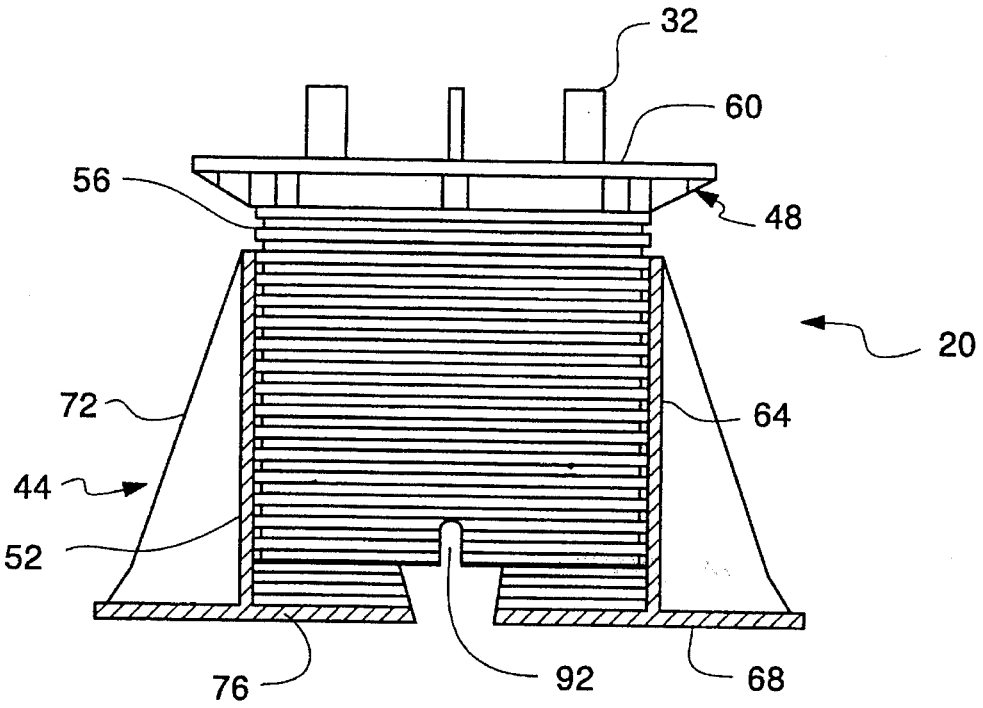
FIG. 4 is a cross-sectional view of the support device.
Figure 9:
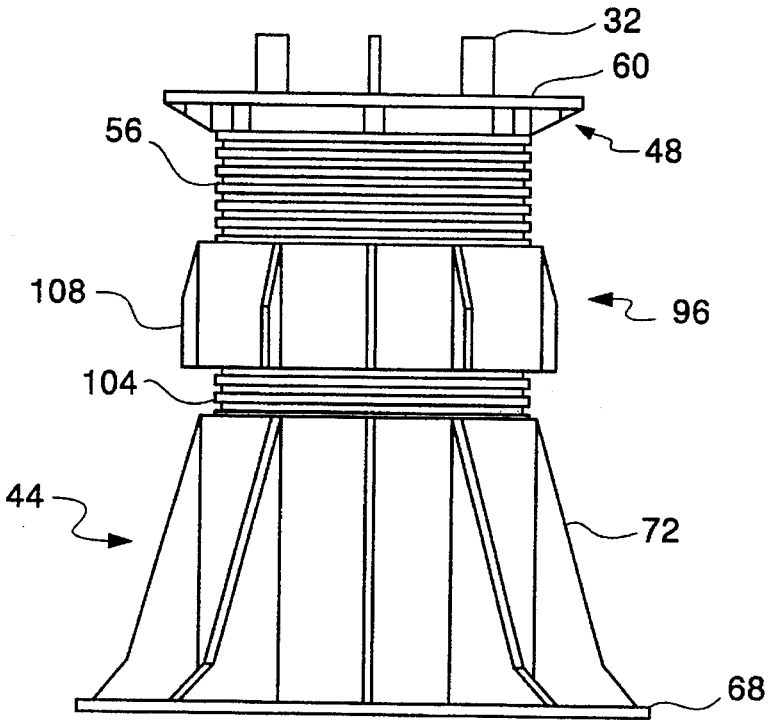
FIG. 9 is a side view of the support device with a coupler member for extending the support member.

Referring to FIG. 4, the support device 20 includes a base member 44 rotatably engaged with a support member 48. The base member 44 includes a threaded cylindrical bore 52 that engages a threaded cylindrical projection 56 on the support member 48. The support member 48 is raised or lowered by rotating the base member 44, relative to the support member 48. As will be appreciated, the use of a threaded support device 20 permits the device 20 to be adjusted to any number of different elevations between the minimum and maximum elevations of the support device 20. This feature is especially useful for leveling over underlying sloping or undulating fixed surfaces which require support devices 20 of different elevations to form a level building surface.

Figure 6:
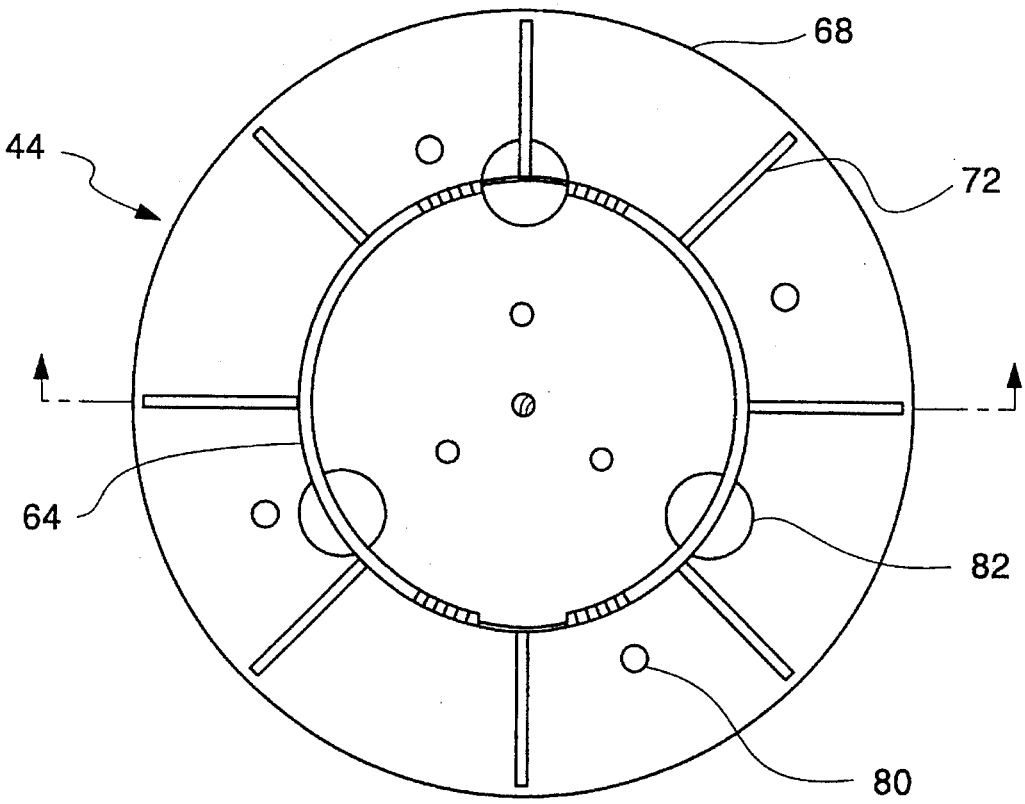
FIG. 6 is a top view of the base member.
Figure 5:
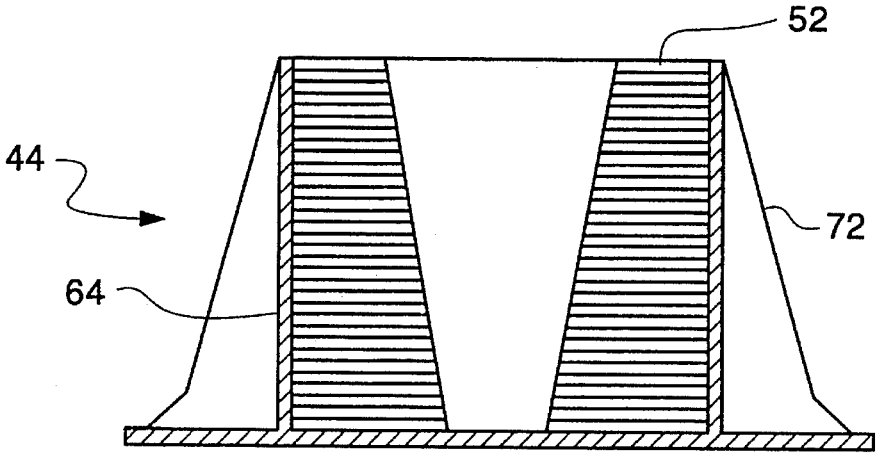
FIG. 5 is a cross-sectional view of the base member of the support device.

Referring to FIGS. 5 and 6, the base member 44 includes a body portion 64, a base portion 68, and one or more flange members 72. The body portion 64 includes the cylindrical bore 52 which contains a plurality of threads 76 having different lengths. Because the support device 20 is manufactured by injection molding techniques, the differing lengths of the threads 76 result from the removal of the mold after forming the base member 44. The base portion 68 includes a number of fastener holes 80 for attaching the base portion 68 to a fixed surface and drainage holes 82 to provide for drainage from the threaded cylindrical bore 52. The flange members 72 support the body portion 64 and improve the load bearing capacity of the support device 20. The drainage holes 82 and flange members 72 are discussed in detail below.

Figure 7:
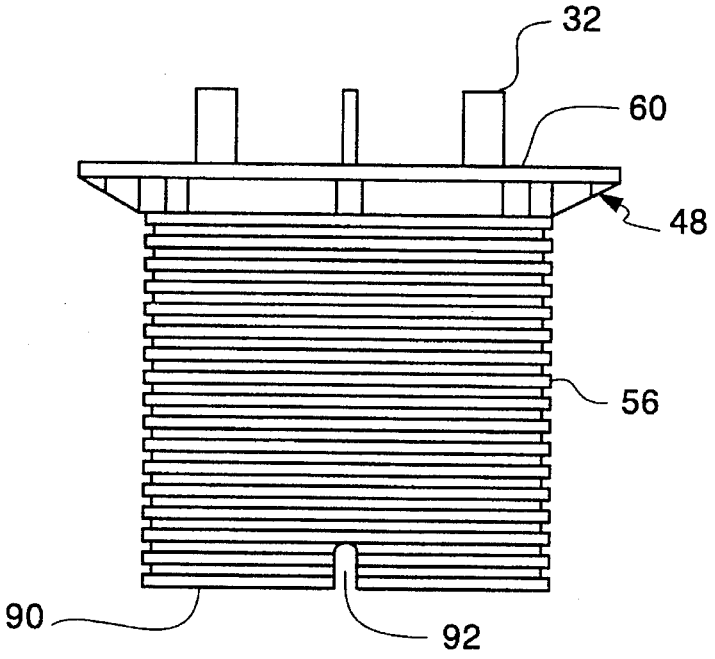
FIG. 7 is a side view of a support member of the support device.
Figure 8:
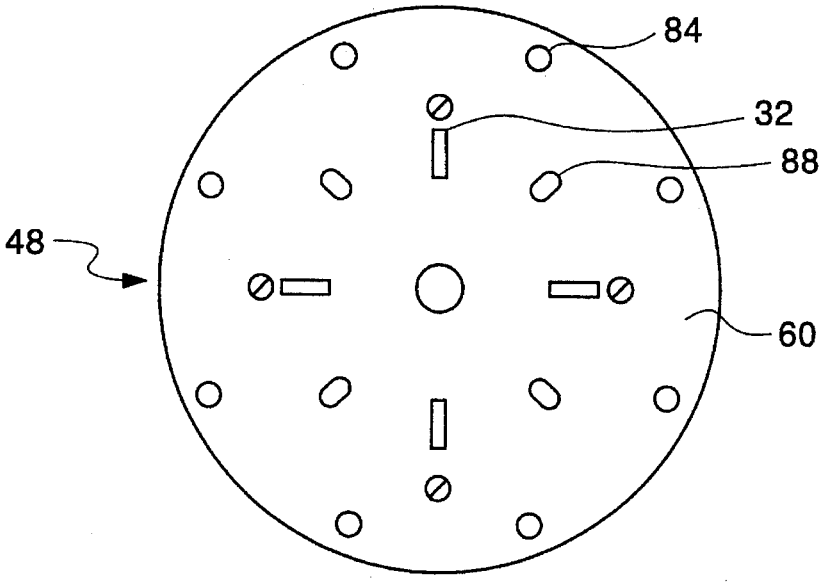
FIG. 8 is a top view of the support member.

Referring to FIGS. 7 and 8, the support member 48 includes one or more spacers 32, a support surface 60, and the threaded cylindrical projection 56.

The spacer 32 is a projected tab having a thickness equal to the desired width of the gap 28 and is perpendicular in relation to the support surface 60. The spacer 32 can be any shape. Referring to FIGS. 1 and 2, the spacer 32 is oriented to uniformly space the edges or corners of the slabs 24. Because the slabs 24 are generally rectangular in shape, the spacers 32 are oriented at right angles relative to one another.

As noted above, the spacers 32 are optionally included on the support surface 60 depending upon the type of building surface to be supported. The spacers 32 can be removed from the support surface 60 to provide a relatively flat, planar surface to support one or more slabs 24, a structural member 36, or a corner support. This feature is useful to support slabs 24 on the outer perimeter of the building surface. By removing the spacers 32, the support device 20 can be placed under the slab 24 so that the support device 20 does not project beyond the building surface perimeter. In many cases, this is an important feature to achieve an aesthetically attractive building surface.

The support surface 60 is a relatively flat surface that includes attachment holes 84 for attaching the support surface 60 to the building surface and inlets 88 to remove fluids, such as water, from the support surface 60 as discussed below. The attachment holes 84 are of a size sufficient to receive fasteners such as screws, dowels, and the like. The support surface 60 can be any shape, such as circular and rectangular. The relative flatness of the support surface 60 permits the support device 20 to support a level building surface even if the device is slightly off vertical.

The threaded cylindrical projection 56 is an important contributor to the load bearing capacity of the support device 20. Slabs and other types of building surfaces apply heavy loads to the support devices 20. The diameter of the threaded cylindrical projection 56 and the thread size and concentration on the threaded cylindrical projection 56 are important contributors to the ability of the device to support such loads. The threaded cylindrical projection preferably has a diameter greater than about 2 inches and more preferably from about 3 to about 4 inches. The threads are preferably not V-shaped threads, such as are typically machined on metal components, but are a heavy duty, semi-rounded thread configuration. The threads preferably have a concentration no more than about 12 and more preferably no more than about 4 to about 5 threads/inch for a total number of about 17 threads.

The support device 20 has other features to enable the device to support heavy loads. By way of example, the support device 20 includes no less than 4 flange members 72 in the base member 44 to provide additional support. The cross-sectional area of the base portion 68 is no less than about 38 $inch^2$ to provide a stable platform for the support device 20. The cross-sectional area of the support surface 60 is no less than about 24 $inch^2$ to provide a stable surface for the load.

The threaded cylindrical projection of support device 20 further includes indicator slots 92 for indicating the maximum extension of the support member 48 above the base member 44. The indicator slots 92 not only enable the lower threads of the threaded cylindrical projection 56 to engage the upper threads of the base member 44 (by permitting the walls of the threaded cylindrical projection 56 to flex inwardly in response to compressive forces exerted against the walls when the lower threads engage the upper threads of the base member 44) but also inform the user (when the indicator slots 92 are visible) that a coupler member (discussed below) and/or a longer threaded cylindrical projection 56 is desirable. The height of the indicator slots 92 is selected based upon the minimum number of engaged threads (e.g., two) required to achieve the desired load bearing capacity for the support device 20.

Another important feature of the support device 20 is the ability to remove fluids, from the support surface 60 and threaded cylindrical bore 52 as well as heat from the threaded cylindrical bore 52. As will be appreciated, the collection of water on the support surface 60 can assist slab deterioration through alternate cycles of freezing and thawing of the collected water. Likewise, collected water in the base portion 44 can cause deterioration of the support device 20 due to freezing and thawing of the water. Heat build up in the support device 20 can further cause deterioration of the device 20.

To protect the support device 20 from the effects of fluids and heat, the support member includes a first fluid pathway and the base member includes a second fluid pathway. The second fluid pathway is represented by the drainage holes 82 in the base portion 68 to remove fluids and heat from the threaded cylindrical bore 52. The fluids and heat are removed through the drainage holes into the environment. The first fluid pathway is in communication with the second fluid pathway and includes the inlets 88 on the support surface 60 and the outlet 90 on the threaded cylindrical projection 56. Liquids drain from the support surface 60 through the inlets 88 into the hollow interior of the threaded cylindrical projection 56. From the interior of the threaded cylindrical projection 56, the fluids flow through the outlet 90 into the threaded cylindrical bore 52 for removal through the drainage holes 82.

Additionally, the composition of the base and support members 44, 48 is selected such that the material is chemically inert and resistant to fluids, such as water and acid. Preferred materials are synthetic plastics, such as polypropylene, nylon, polystyrene, polycarbonate (with or without reinforcing fibers) and composites thereof. These materials provide the added benefit that a building surface can be mechanically fastened or screwed into the material and thereby fastened to the support surface of the support member. Metal materials, such as steel, are generally unsuitable for such applications as they can rust or corrode over time.

Figure 10:
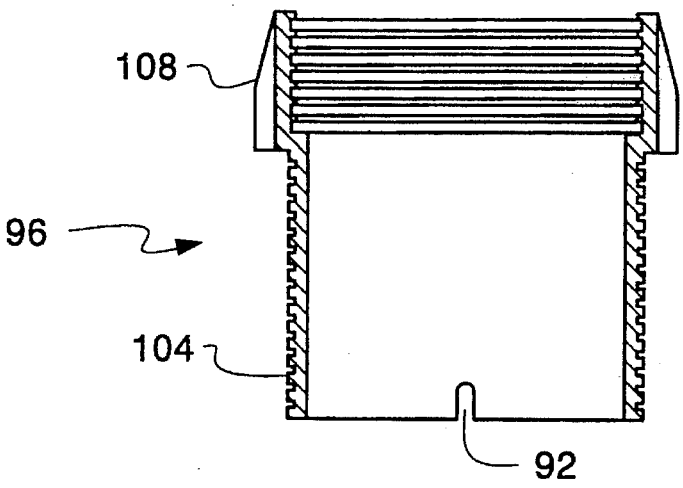
FIG. 10 is a cross-sectional view of a coupler member.

To increase the maximum elevation of the support device 20, the support device 20 can include a coupler member for extending the support member. Referring to FIG. 10, the coupler member 96 includes a second threaded cylindrical bore 100 to engage the threaded cylindrical projection 56 on the support member 48 and a second threaded cylindrical projection 104 to engage the threaded cylindrical bore 52 in the base member 44. The elevation of the support device 20 preferably ranges from approximately 1 inch to about 24 inches, and the height of the elongated member 108 preferably ranges from about 2 to about 3 inches.

Referring to FIGS. 1 and 2, the steps to use the support device 20 will now be described. The steps do not generally depend upon the type of building surface to be supported. Accordingly, the steps for using support devices 20 to support a building surface composed of slabs will be described.

Figure 11:
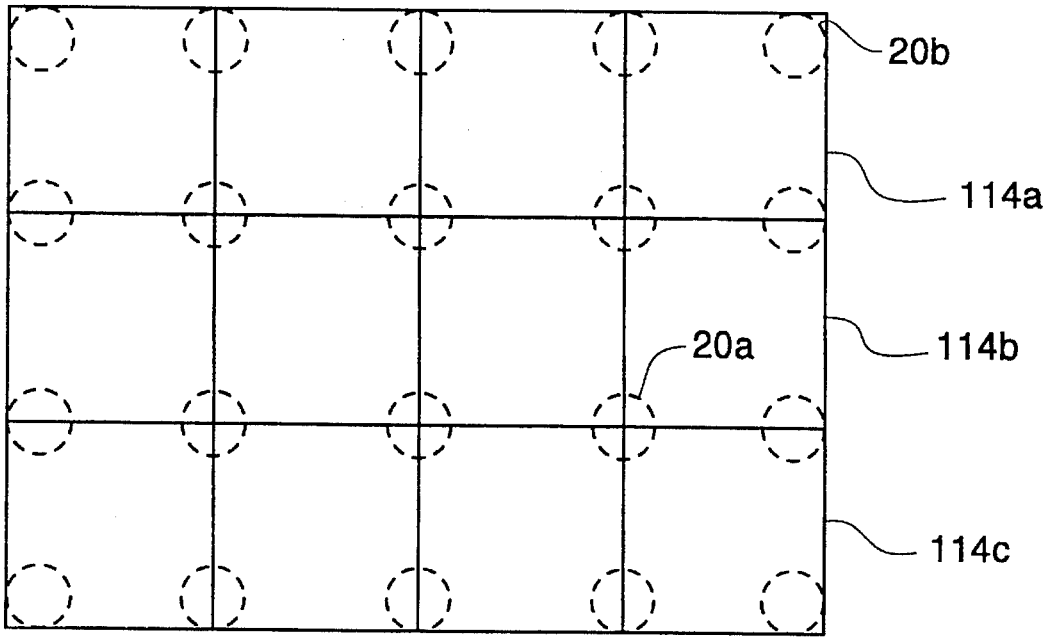
FIG. 11 is a top view of a number of support devices being used to support a plurality of slabs arranged in a grid pattern.

Referring to FIG. 11, the slabs 24 are typically laid out in a grid pattern and are installed either row by row or column by column. For example, row **114*a* is installed before row 114*b*, and row 114*b* before row 114*c***, and so forth.

Figure 12:
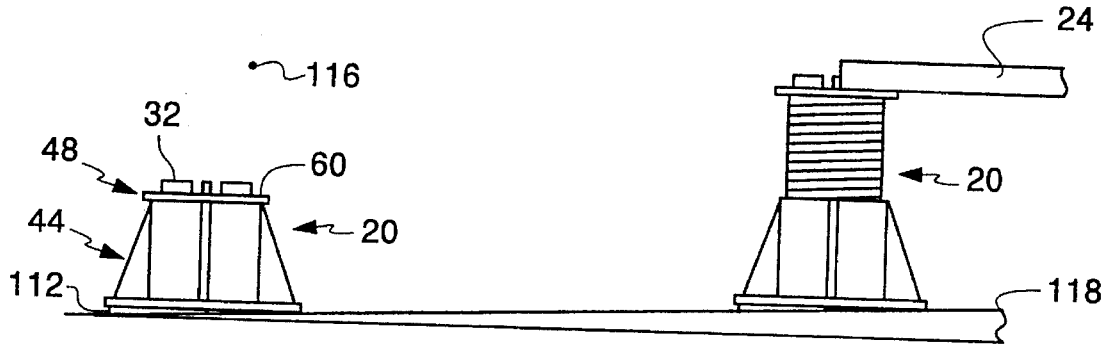
FIG. 12 is a side view of a row or column of support devices before slab installation.

Referring to FIG. 12, to initiate the installation of a row or column of the grid pattern, a mason's line 116 (shown normal to the plane of the page) is generally extended across the anticipated locations of the support devices for the next row or column to be installed to establish the desired orientation of the building surface. Generally, the building surface is substantially level. For a sloping fixed surface 118, the elevation of the building surface depends upon the elevation of the highest point of the fixed surface. This point is typically the starting point for installation of the building surface.

In extremely sloping surfaces 118, shims 112 can, but do not have to, be used to level the support device 20 on the surface 118.

After the mason's line 116 is properly positioned, the row or column of support devices 20 is positioned beneath the mason's line at appropriate intervals based on the width of the slabs. The slabs are typically 2 feet by 2 feet so the distance between the adjacent support devices 20*a* is generally 2 feet. The distance between adjacent support devices 20*b* may be increased by placing support devices in the middle of a slab.

Figure 13:
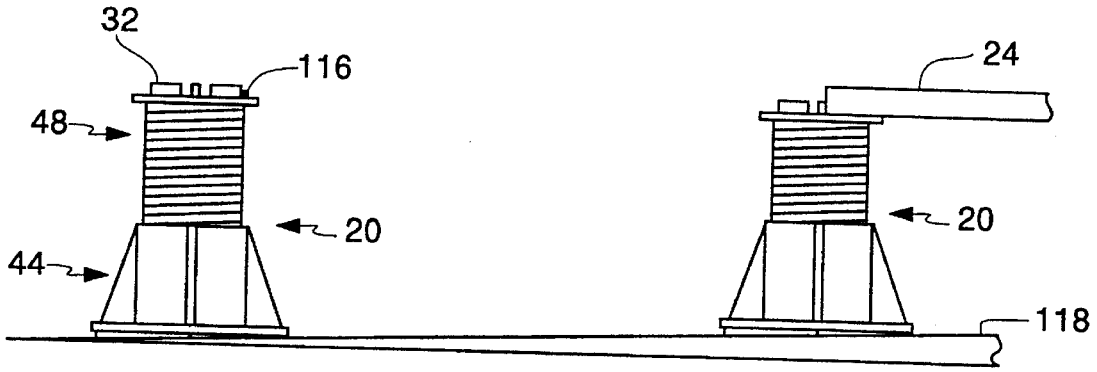
FIG. 13 is another side view of a row or column of support devices before slab installation.

Referring to FIG. 13, after positioning the row or column of support devices 20, each support device 20 is elevated by aligning the spacers 32 with the slab grid pattern and rotating the base member 44 until the support surface 60 is at the same elevation as the mason's line 116. Typically, the base member 44 and not the support member 48 is rotated to elevate the support surface 60 as this permits the spacers 32 to be aligned with the grid pattern prior to rotation. If the indicator slots 92 are visible, a longer threaded cylindrical projection 52 and/or coupler member 96 is utilized. For the sloping fixed surface 118, the support devices 20 will generally have differing elevations and therefore differing degrees of extension to provide a substantially level building surface.

As shown in FIG. 11, a support device 20 is positioned at each corner of the slabs 24. In this position, each support device 20 will engage up to four slabs 24. As noted above, the spacers 32 can be removed. This can be useful where the device is placed in the middle area of a slab or at the perimeter to permit the support surface 60 to engage the interior surface of a slab 24 and thereby keep the support device 20 from projecting beyond the perimeter of the building surface.

Figure 14:
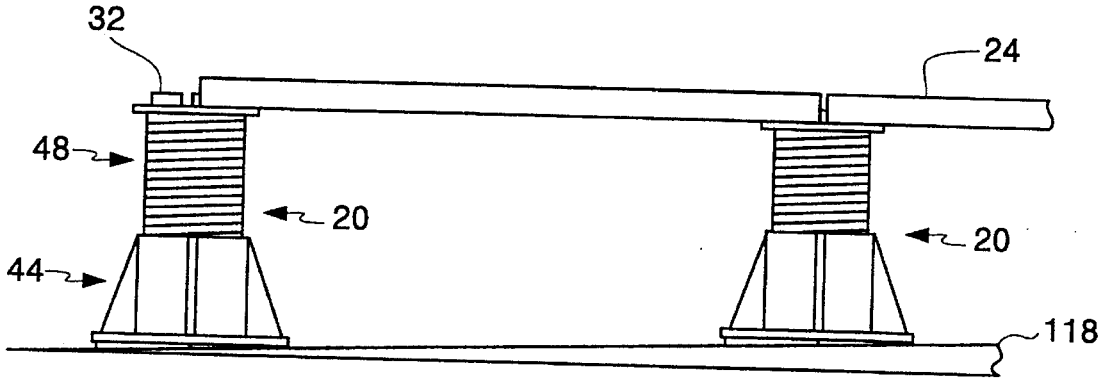
FIG. 14 is a side view of a row or column of support devices after slab installation.

Referring to FIG. 14, after the row or column of support members are properly positioned, aligned, and adjusted, the slab 24 is engaged with the support devices 20. A cementitious slab is typically not attached to the support surface 60 but rests on the support member because its weight holds it in place. After placement of the slabs 24 on the support members 20, minor adjustments in the elevation of the support devices can be made by rotating the base member. As noted above, the preceding process is repeated row by row or column by column until the building surface is installed.

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. An apparatus for elevating a building surface above a fixed surface, comprising: a base member having an interior and including a base portion for engaging the fixed surface and a body portion and at least one flange member supporting said body portion relative to said base portion joined to said base portion and having a length that extends away from said base portion;

a support member having an inlet and including means for engaging the building surface, said support member being rotatably engaged with said body portion along said length thereof wherein rotation of said base member relative to said support member elevates said engaging means, wherein the apparatus includes;

i) a threaded cylindrical projection on at least one of said base and support members for engaging a threaded cylindrical bore on at least one of said base and support members, wherein the threaded cylindrical projection has a diameter of at least about 2 inches; and ii) a first threaded surface on at least one of said base and support members, wherein the first threaded surface has no more than about 5 threads per inch;

said base portion having contacting portions that contact the fixed surface, said base portion being free from attachment to the fixed surface in order to permit rotation of said base portion relative to said support member wherein, when elevation of said means for engaging is conducted, said base portion including said contacting portions thereof rotate relative to said support member in order to raise said means for engaging;

at least one inlet formed in said support member through which fluid is able to pass into said interior of said support member; and at least one outlet formed in said base member that communicates with said inlet in order to pass fluid during the entire time that the apparatus is elevating the building surface, said outlet being positioned and configured to pass fluid from said interior of said base member in a direction different from parallel to said length of said body portion so that the fluid passes from said interior in a direction different from downwardly beyond said contacting portions.

2. The apparatus as claimed in claim 1, wherein:

said body portion includes a threaded cylindrical bore and the length of a first thread in an upper portion of said threaded cylindrical bore is less than the length of a second thread in a lower portion of said threaded cylindrical bore.

3. The apparatus as claimed in claim 1, wherein:

a first threaded surface is provided on at least one of said base member and said support member and in which the threads on said first threaded surface are semi-rounded.

4. The apparatus as claimed in claim 1, wherein:

at least one of said support member and said base member includes means for indicating the maximum extension of said support member above said base member, said means for indicating including an indicator slot and said indicator slot extending for a predetermined number of threads located on said one of said support and base members and with said indicator slot being movable when said base member rotates relative to said support member.

5. An apparatus for supporting a platform which may be exposed to fluids, comprising:

a support member having a support surface to engage the platform having a first threaded surface and a first fluid pathway having an input on the support surface for removing fluids from the support surface;

a base member having a second threaded surface for engaging the first threaded surface and a second fluid pathway in communication with the first fluid pathway and having a plurality of outlets in the base member for transporting fluids radially outward from said base and support members into the exterior environment, wherein said base member includes contacting portions that contact a fixed surface on which said base member is supported and in which the support surface is elevated by rotating said contacting portions of said base member relative to said support member; and means for indicating provided with at least one of said support member and said base member, said means for indicating including an indicator slot formed in one of said first threaded surface and said second threaded surface with said indicator slot extending for a predetermined number of threads and with said indicator slot being movable when said contacting portions of said base member rotate relative to said support member.

6. A method for elevating a building surface above a fixed surface, comprising the steps of:

providing a support member and a base member having contacting portions with one of said support member and said base member having a length and an indicator located along said length;

positioning said support member for engaging the building surface and said contacting portions of said base member for engaging the fixed surface in a selected location, wherein said support member rotatably engages said base member and said contacting portions of said base member are movably supported on the fixed surface;

engaging said support member with said building surface;

after said engaging step rotating said base member including said contacting portions to elevate said support member to a first height;

determining that said support member should not be further elevated beyond said first height using said indicator;

discontinuing said rotating of said base member including said contacting portions based on said determining step;

connecting a coupler member to at least one of said support member and said base member but not until after said rotating, determining and discontinuing steps, said coupler member interconnecting said support member and said base member to permit said support member to be elevated to a second height which is greater than said first height; and continuing said rotating of said base member including said contacting portions after said connecting step to elevate said support member to said second height.

* * * * *